US009719406B2

(12) United States Patent
Gonze et al.

(10) Patent No.: US 9,719,406 B2
(45) Date of Patent: Aug. 1, 2017

(54) ENGINE OUT COOLANT TEMPERATURE CORRECTION

(71) Applicant: GM Global Technology Operations LLC, Detroit, MI (US)

(72) Inventors: Eugene V. Gonze, Pickney, MI (US); Yue-Ming Chen, Canton, MI (US); Vijay Ramappan, Novi, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 113 days.

(21) Appl. No.: 14/593,157

(22) Filed: Jan. 9, 2015

(65) Prior Publication Data

US 2016/0201547 A1 Jul. 14, 2016

(51) Int. Cl.
*F01P 7/14* (2006.01)
*F01P 7/16* (2006.01)

(52) U.S. Cl.
CPC ..... *F01P 7/164* (2013.01); *F01P 7/14* (2013.01); *F01P 2007/146* (2013.01); *F01P 2025/32* (2013.01); *F01P 2025/64* (2013.01); *F01P 2037/00* (2013.01)

(58) Field of Classification Search
CPC ..... F01P 3/20; F01P 5/10; F01P 7/14; F01P 7/16; F01P 7/164; F01P 2007/14; F01P 2007/146; B60W 50/02; B60W 50/0205; F02B 29/04; F02B 29/0443
USPC ..... 123/41.01, 41.05, 41.08, 41.12, 41.13, 123/41.1, 41.41; 701/107, 113–115
See application file for complete search history.

*Primary Examiner* — John Kwon
*Assistant Examiner* — Johnny H Hoang

(57) ABSTRACT

A coolant control system of a vehicle includes a coolant valve control module and a pump control module. The coolant valve control module determines a position of a coolant valve. The pump control module determines a speed of a coolant pump based on the position of the coolant valve and a desired coolant output temperature, measures a coolant output temperature, determines a difference between the desired coolant output temperature and the measured coolant output temperature, generates a correction factor based on the difference between the desired coolant output temperature and the measured coolant output temperature, and applies the correction factor to the speed of the coolant pump.

14 Claims, 4 Drawing Sheets

ENGINE OUT COOLANT TEMPERATURE CORRECTION

FIELD

The present disclosure relates to vehicles with internal combustion engines and more particularly to systems and methods for controlling engine coolant flow.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

An internal combustion engine combusts air and fuel within cylinders to generate drive torque. Combustion of air and fuel also generates heat and exhaust. Exhaust produced by an engine flows through an exhaust system before being expelled to atmosphere.

Excessive heating may shorten the lifetime of the engine, engine components, and/or other components of a vehicle. As such, vehicles that include an internal combustion engine typically include a radiator that is connected to coolant channels within the engine. Engine coolant circulates through the coolant channels and the radiator. The engine coolant absorbs heat from the engine and carries the heat to the radiator. The radiator transfers heat from the engine coolant to air passing the radiator. The cooled engine coolant exiting the radiator is circulated back to the engine.

SUMMARY

A coolant control system of a vehicle includes a coolant valve control module and a pump control module. The coolant valve control module determines a position of a coolant valve. The pump control module determines a speed of a coolant pump based on the position of the coolant valve and a desired coolant output temperature, measures a coolant output temperature, determines a difference between the desired coolant output temperature and the measured coolant output temperature, generates a correction factor based on the difference between the desired coolant output temperature and the measured coolant output temperature, and applies the correction factor to the speed of the coolant pump.

A method for operating a coolant control system of a vehicle includes determining a position of a coolant valve, determining a speed of a coolant pump based on the position of the coolant valve and a desired coolant output temperature, measuring a coolant output temperature, determining a difference between the desired coolant output temperature and the measured coolant output temperature, generating a correction factor based on the difference between the desired coolant output temperature and the measured coolant output temperature, and applying the correction factor to the speed of the coolant pump.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

An engine combusts air and fuel to generate drive torque. A coolant system includes a coolant pump that circulates coolant through various portions of the engine, such as a cylinder head, an engine block, and an integrated exhaust manifold (IEM). Traditionally, the engine coolant is used to absorb heat from the engine, engine oil, transmission fluid, and other components and to transfer heat to air via one or more heat exchangers.

A pump control module controls the coolant pump based on a target flowrate of coolant through the engine. The pump control module may determine the target flowrate based on a torque output of the engine and an engine speed. Determining the target flowrate based on the engine torque output and the engine speed may enable coolant flow to be controlled to provide sufficient cooling for the operating conditions and to also avoid overcooling to maximize fuel efficiency.

Variations in components of the coolant system (e.g., pressure variations within the coolant system, component failure, etc.) may interfere with accurate coolant flow control. Inaccurate coolant flow control may impair engine cooling and decrease fuel efficiency. The pump control module according to the principles of the present disclosure adjusts a coolant pump speed (i.e., coolant pump RPM) to compensate for these variations. For example, the pump control module generates a correction factor based on desired coolant flow, coolant valve positions, and engine coolant output temperature and applies the correction factor to the coolant pump RPM.

Figure 1:
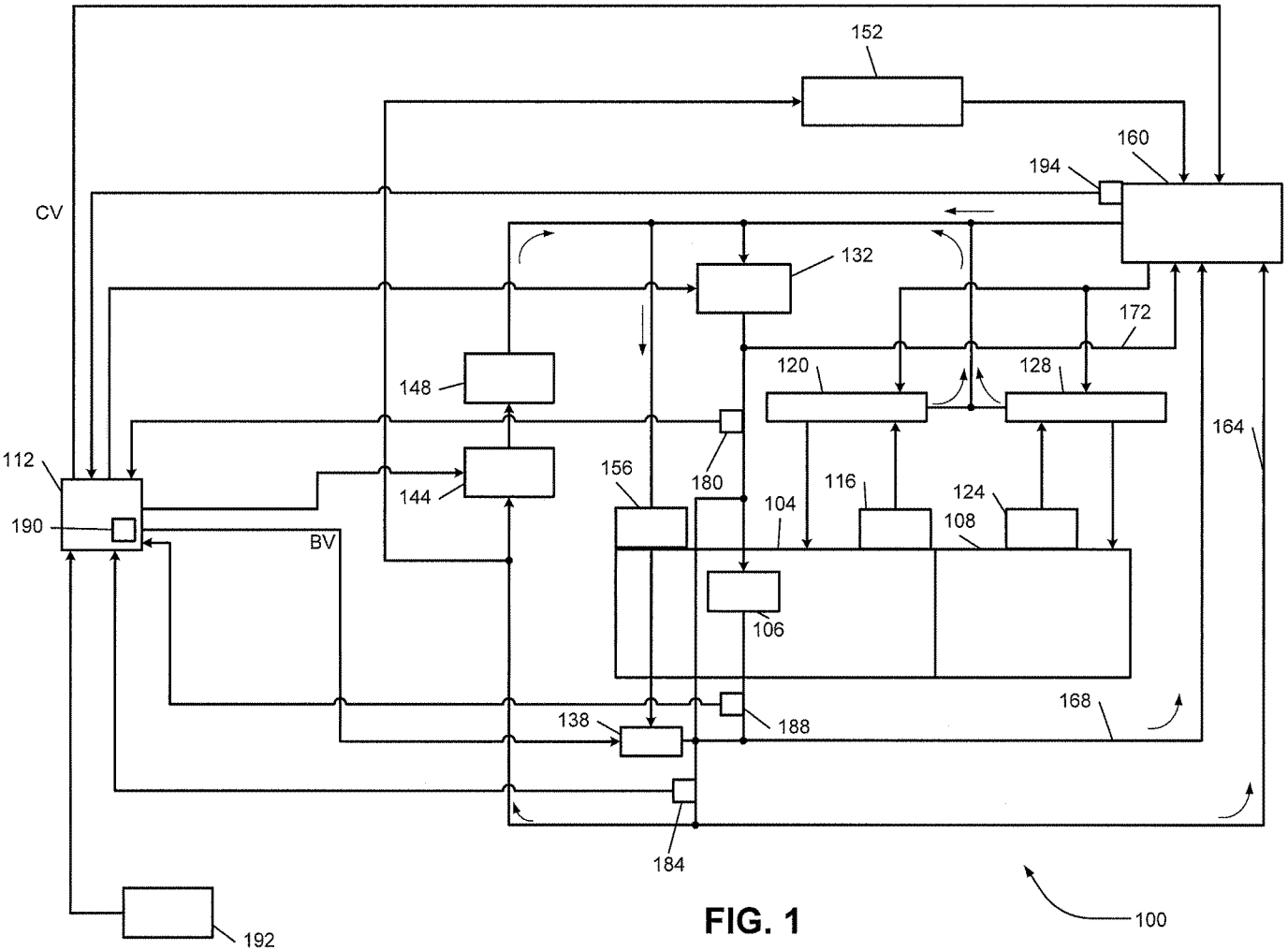
FIG. 1 is a functional block diagram of an example vehicle system according to the principles of present disclosure.

Referring now to FIG. 1, a functional block diagram of an example vehicle system 100 is presented. An engine 104 combusts a mixture of air and fuel within cylinders to generate drive torque. An integrated exhaust manifold (IEM) 106 receives exhaust output from the cylinders and is integrated with a portion of the engine 104, such as a head portion of the engine 104.

The engine 104 outputs torque to a transmission 108. The transmission 108 transfers torque to one or more wheels of a vehicle via a driveline (not shown). An engine control module (ECM) 112 may control one or more engine actuators to regulate the torque output of the engine 104.

An engine oil pump 116 circulates engine oil through the engine 104 and a first heat exchanger 120. The first heat exchanger 120 may be referred to as an (engine) oil cooler or an oil heat exchanger (HEX). When the engine oil is cold, the first heat exchanger 120 may transfer heat to engine oil within the first heat exchanger 120 from coolant flowing through the first heat exchanger 120. The first heat exchanger 120 may transfer heat from the engine oil to coolant flowing through the first heat exchanger 120 and/or to air passing the first heat exchanger 120 when the engine oil is warm.

A transmission fluid pump 124 circulates transmission fluid through the transmission 108 and a second heat exchanger 128. The second heat exchanger 128 may be referred to as a transmission cooler or as a transmission heat exchanger. When the transmission fluid is cold, the second heat exchanger 128 may transfer heat to transmission fluid within the second heat exchanger 128 from coolant flowing through the second heat exchanger 128. The second heat exchanger 128 may transfer heat from the transmission fluid to coolant flowing through the second heat exchanger 128 and/or to air passing the second heat exchanger 128 when the transmission fluid is warm.

The engine 104 includes a plurality of channels through which engine coolant ("coolant") can flow. For example, the engine 104 may include one or more channels through the head portion of the engine 104, one or more channels through a block portion of the engine 104, and/or one or more channels through the IEM 106. The engine 104 may also include one or more other suitable coolant channels.

When a coolant pump 132 is on, the coolant pump 132 pumps coolant to various channels. While the coolant pump 132 is shown and will be discussed as an electric coolant pump, the coolant pump 132 may alternatively be mechanically driven (e.g., by the engine 104) or another suitable type of variable output coolant pump.

A block valve (BV) 138 may regulate coolant flow out of (and therefore through) the block portion of the engine 104. A heater valve 144 may regulate coolant flow to (and therefore through) a third heat exchanger 148. The third heat exchanger 148 may also be referred to as a heater core. Air may be circulated past the third heat exchanger 148, for example, to warm a passenger cabin of the vehicle.

Coolant output from the engine 104 also flows to a fourth heat exchanger 152. The fourth heat exchanger 152 may be referred to as a radiator. The fourth heat exchanger 152 transfers heat to air passing the fourth heat exchanger 152. A cooling fan (not shown) may be implemented to increase airflow passing the fourth heat exchanger 152.

Various types of engines may include one or more turbochargers, such as turbocharger 156. Coolant may be circulated through a portion of the turbocharger 156, for example, to cool the turbocharger 156.

A coolant valve 160 may include a multiple input, multiple output valve or one or more other suitable valves. In various implementations, the coolant valve 160 may be partitioned and have two or more separate chambers. An example diagram illustrating coolant flow to and from an example where the coolant valve 160 includes 2 coolant chambers is provided in FIG. 2. The ECM 112 controls actuation of the coolant valve 160.

Figure 2:
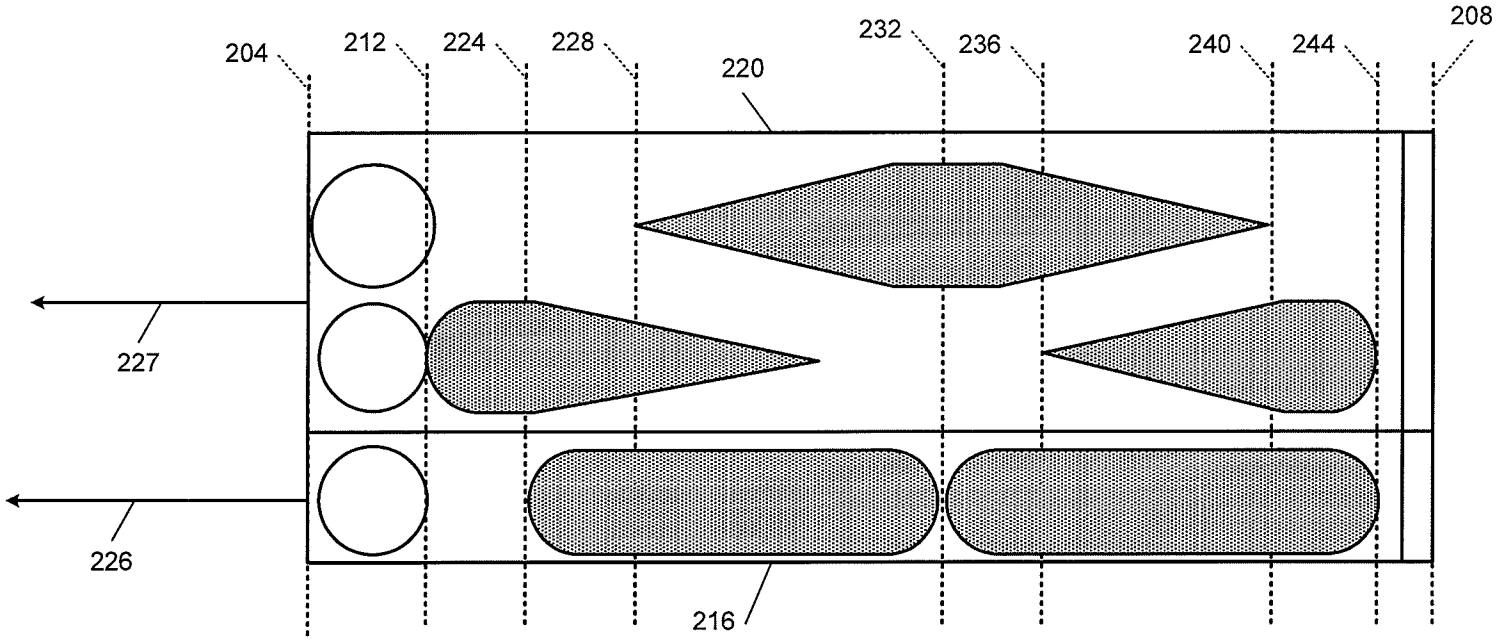
FIG. 2 is an example diagram illustrating coolant flow to and from a coolant valve for various positions of the coolant valve.

Referring now to FIGS. 1 and 2, the coolant valve 160 can be actuated between two end positions 204 and 208. When the coolant valve 160 is positioned between the end position 204 and a first position 212, coolant flow into a first one of the chambers 216 is blocked, and coolant flow into a second one of the chambers 220 is blocked.

The coolant valve 160 outputs coolant from the first one of the chambers 216 to the first heat exchanger 120 and the second heat exchanger 128 as indicated by 226. The coolant valve 160 outputs coolant from the second one of the chambers 220 to the coolant pump 132 as indicated by 227.

When the coolant valve 160 is positioned between the first position 212 and a second position 224, coolant flow into the first one of the chambers 216 is blocked and coolant output by the engine 104 flows into the second one of the chambers 220 via a first coolant path 164. Coolant flow into the second one of the chambers 220 from the fourth heat exchanger 152, however, is blocked.

When the coolant valve 160 is positioned between the second position 224 and a third position 228, coolant output by the IEM 106 via a second coolant path 168 flows into the first one of the chambers 216, coolant output by the engine 104 flows into the second one of the chambers 220 via the first coolant path 164, and coolant flow into the second one of the chambers 220 from the fourth heat exchanger 152 is blocked. The ECM 112 may actuate the coolant valve 160 to between the second and third positions 224 and 228, for example, to warm the engine oil and the transmission fluid.

When the coolant valve 160 is positioned between the third position 228 and a fourth position 232, coolant output by the IEM 106 via the second coolant path 168 flows into the first one of the chambers 216, coolant output by the engine 104 flows into the second one of the chambers 220 via the first coolant path 164, and coolant output by the fourth heat exchanger 152 flows into the second one of the chambers 220. Coolant flow into the first one of the chambers 216 from the coolant pump 132 via a third coolant path 172 is blocked when the coolant valve 160 is between the end position 204 and the fourth position 232. The ECM 112 may actuate the coolant valve 160 to between the third and fourth positions 228 and 232, for example, to warm the engine oil and the transmission fluid.

When the coolant valve 160 is positioned between the fourth position 232 and a fifth position 236, coolant output by the coolant pump 132 flows into the first one of the chambers 216 via the third coolant path 172, coolant flow into the second one of the chambers 220 via the first coolant path 164 is blocked, and coolant output by the fourth heat exchanger 152 flows into the second one of the chambers 220. When the coolant valve 160 is positioned between the fifth position 236 and a sixth position 240, coolant output by the coolant pump 132 flows into the first one of the chambers 216 via the third coolant path 172, coolant output by the engine 104 flows into the second one of the chambers 220 via the first coolant path 164, and coolant output by the fourth heat exchanger 152 flows into the second one of the chambers 220.

When the coolant valve 160 is positioned between the sixth position 240 and a seventh position 244, coolant output by the coolant pump 132 flows into the first one of the chambers 216 via the third coolant path 172, coolant output by the engine 104 flows into the second one of the chambers 220 via the first coolant path 164, and coolant flow from the fourth heat exchanger 152 into the second one of the chambers 220 is blocked.

Coolant flow into the first one of the chambers 216 from the IEM 106 via the second coolant path 168 is blocked when the coolant valve 160 is between the fourth position 232 and the seventh position 244. The ECM 112 may actuate the coolant valve 160 to between the fourth and seventh positions 232 and 244, for example, to cool the engine oil and the transmission fluid. Coolant flow into the first and second chambers 216 and 220 is blocked when the coolant valve 160 is positioned between the seventh position 244 and the end position 208. The ECM 112 may actuate the coolant valve 160 to between the seventh position 244 and the end position 208, for example, for performance of one or more diagnostics.

Referring back to FIG. 1, a coolant input temperature sensor 180 measures a temperature of coolant input to the engine 104. A coolant output temperature sensor 184 measures a temperature of coolant output from the engine 104. An IEM coolant temperature sensor 188 measures a temperature of coolant output from the IEM 106. A coolant valve position sensor 194 measures a position of the coolant valve 160. One or more other sensors 192 may be implemented, such as an oil temperature sensor, a transmission fluid temperature sensor, one or more engine (e.g., block and/or head) temperature sensors, a radiator output temperature sensor, a crankshaft position sensor, a mass air flowrate (MAF) sensor, a manifold absolute pressure (MAP) sensor, and/or one or more other suitable vehicle sensors. One or more other heat exchangers may also be implemented to aid in cooling and/or warming of vehicle fluid(s) and/or components.

Output of the coolant pump 132 varies as the pressure of coolant input to the coolant pump 132 varies. For example, at a given speed of the coolant pump 132, the output of the coolant pump 132 increases as the pressure of coolant input to the coolant pump 132 increases, and vice versa. The position of the coolant valve 160 varies the pressure of coolant input to the coolant pump 132. A coolant control module 190 (see also FIG. 3) controls the speed of the coolant pump 132 based on the position of the coolant valve 160 to more accurately control the output of the coolant pump 132. While the coolant control module 190 is illustrated as being located within the ECM 112, the coolant control module 190 may be implemented within another module or independently.

Accordingly, coolant flow and a temperature of coolant output from the engine 104 may vary with changes in positions of the coolant valve 160. Therefore, a required speed of the coolant pump 132 to maintain a desired temperature of coolant output from the engine 104 also varies with changes in positions of the coolant valve 160. Further, coolant flow may increase and decrease between changes in positions of the coolant valve 160 due to component variation, wear, failure, etc., such as pinched or clogged conduits, clogged valves, and/or other faults. For example, a speed of the coolant pump 132 in a first position of the coolant valve 160 may be sufficient to maintain the desired temperature of coolant output from the engine 104. Conversely, a speed of the coolant pump 132 in a second position of the coolant valve 160 may not be sufficient to maintain the desired temperature of coolant output from the engine 104 due to component variation. Similarly, a speed of the coolant pump 132 in a given position of the coolant valve 160 may be initially be sufficient to maintain the desired temperature of coolant output from the engine 104 but may not be sufficient at a later time due to component variation. Some faults (e.g., a damaged coolant pump 132) may result in reduced coolant flow (and therefore an increased temperature of coolant output from the engine 104) in some or all of the positions of the coolant valve 160.

The coolant control module 190 according to the principles of the present disclosure adjusts a speed of the coolant pump 132 using a correction factor. For example, the coolant control module 190 generates (e.g., using a pump control module as described below in FIG. 3) a correction factor based on one or more characteristics of the coolant system. The one or more characteristic include, but are not limited to, desired coolant flow, the positions of the coolant valve 160 as measured by the coolant valve position sensor 194, and the engine coolant output temperature as measured by the coolant output temperature sensor 184. The coolant control module 190 may generate a different correction factor for each of the positions of the coolant valve 160 based on the engine coolant output temperature associated with the respective position of the coolant valve 160.

Figure 3:
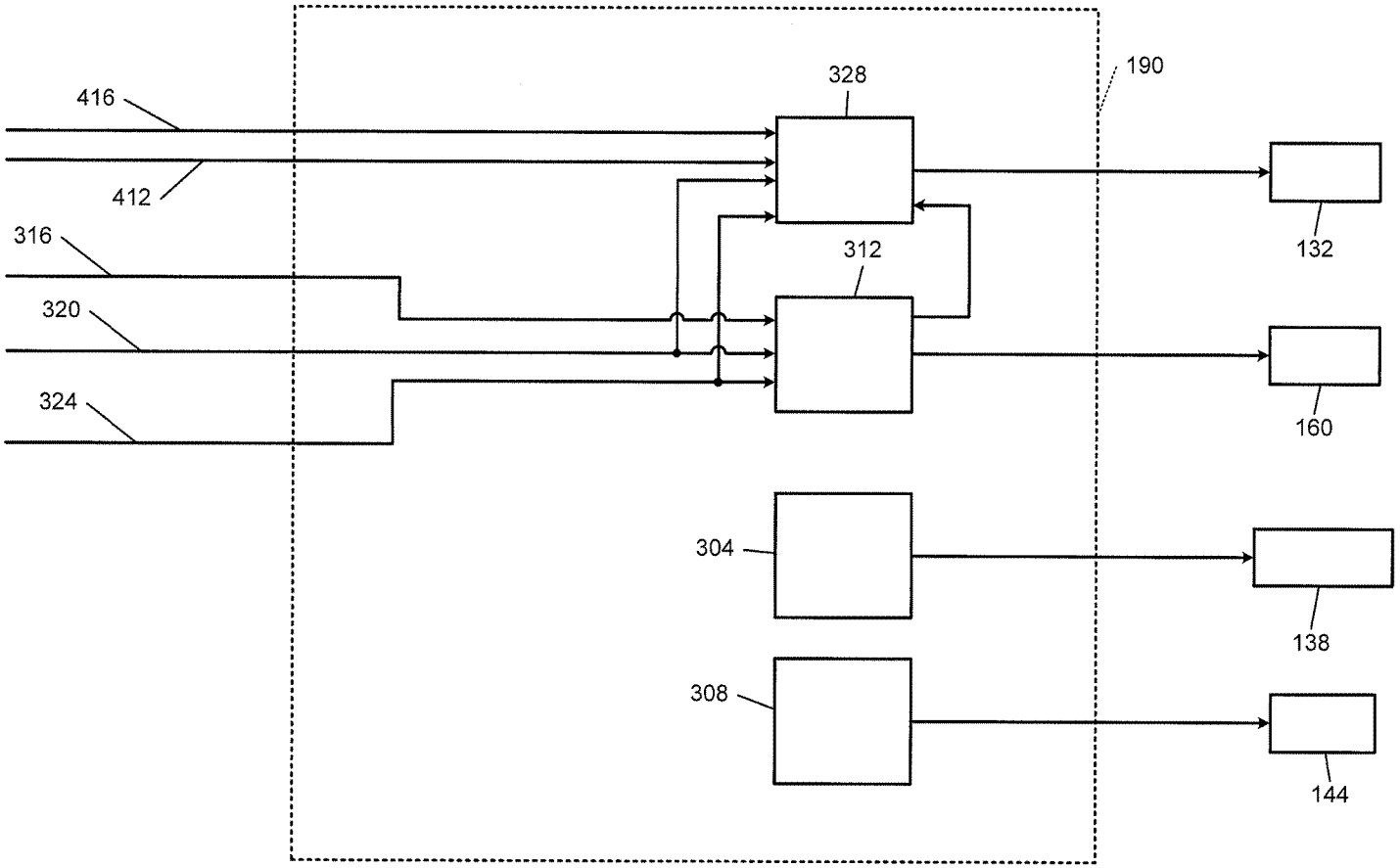
FIG. 3 is a functional block diagram of an example coolant control module according to the principles of present disclosure.

Referring now to FIG. 3, a functional block diagram of an example implementation of the coolant control module 190 is presented. A block valve control module 304 controls the block valve 138. For example, the block valve control module 304 controls whether the block valve 138 is open (to allow coolant flow through the block portion of the engine 104) or closed (to prevent coolant flow through the block portion of the engine 104).

A heater valve control module 308 controls the heater valve 144. For example, the heater valve control module 308 controls whether the heater valve 144 is open (to allow coolant flow through the third heat exchanger 148) or closed (to prevent coolant flow through the third heat exchanger 148).

A coolant valve control module 312 controls the coolant valve 160. As described above, the position of the coolant valve 160 controls coolant flow into the chambers of the coolant valve 160 and also controls coolant flow out of the coolant valve 160. The coolant valve control module 312 may control the coolant valve 160, for example, based on an IEM coolant temperature 316, an engine coolant output temperature 320, an engine coolant input temperature 324, and/or one or more other suitable parameters. The IEM coolant temperature 316, the engine coolant output temperature 320, and the engine coolant input temperature 324 may be, for example, measured using the IEM coolant temperature sensor 188, the coolant input temperature sensor 180, and the coolant output temperature sensor 184, respectively.

A pump control module 328 controls the speed of the coolant pump 132 according to a desired engine coolant output temperature and a corresponding coolant flow rate. In other words, the pump control module 328 controls the speed of the coolant pump 132 to generate a coolant flow rate to achieve the desired engine coolant output temperature. The speed of the coolant pump 132 required to achieve the desired engine coolant output temperature at a given position of the coolant valve 160 may be calibrated based on, for example, an initial vehicle condition. The coolant valve control module 312 may provide a signal to the pump control module 328 indicating the selected position of the coolant valve 160. In this manner, the pump control module 328 selects controls the speed of the coolant pump 132 for the selected position of the coolant valve 160.

If the engine coolant output temperature 320 differs from the desired engine coolant output temperature for the selected position of the coolant valve 160 and the corresponding speed of the coolant pump 132, the pump control module 328 generates a correction factor to be applied to the speed of the coolant pump 132 for the selected position of the coolant valve 160. For example, the correction factor may correspond to a multiplier that is applied to the speed of the coolant pump 132. For example, only, if S corresponds to the calibrated speed of the coolant pump 132 according to factors including, but not limited to, a position of the coolant valve 160, the desired engine coolant outlet temperature, etc., the correction factor may correspond to a modifier (e.g., a multiplier or coefficient) C that is applied to the speed S (e.g., C*S).

The pump control module 328 may calculate the correction factor C based on a difference between the engine coolant output temperature 320 and the desired engine coolant output temperature. For example, if the engine coolant output temperature 320 exceeds the desired engine coolant output temperature for the selected position of the coolant valve 160, the correction factor C may be calculated to increase the speed S of the coolant pump 132 (e.g., C may be set to 1.1, 1.2, etc.). Conversely, if the engine coolant output temperature 320 is less than the desired engine coolant output temperature for the selected position of the coolant valve 160, the correction factor C may be calculated to decrease the speed S of the coolant pump 132 (e.g., C may be set to 0.90, 0.95 etc.).

The pump control module 328 may calculate and store a plurality of correction factors for respective positions of the coolant valve 160. For example, the pump control module 328 may store a map or lookup table correlating each of the positions of the coolant valve 160 to a different correction factor. The stored correction factors for the respective positions of the coolant valve 160 may be recalculated and/or updated by the pump control module 328 to maintain the desired engine coolant output temperature for each position of the coolant valve 160. Accordingly, each time the position of the coolant valve 160 is changed, the pump control module 328 applies the corresponding correction factor to the speed of the coolant pump 132.

Figure 4:
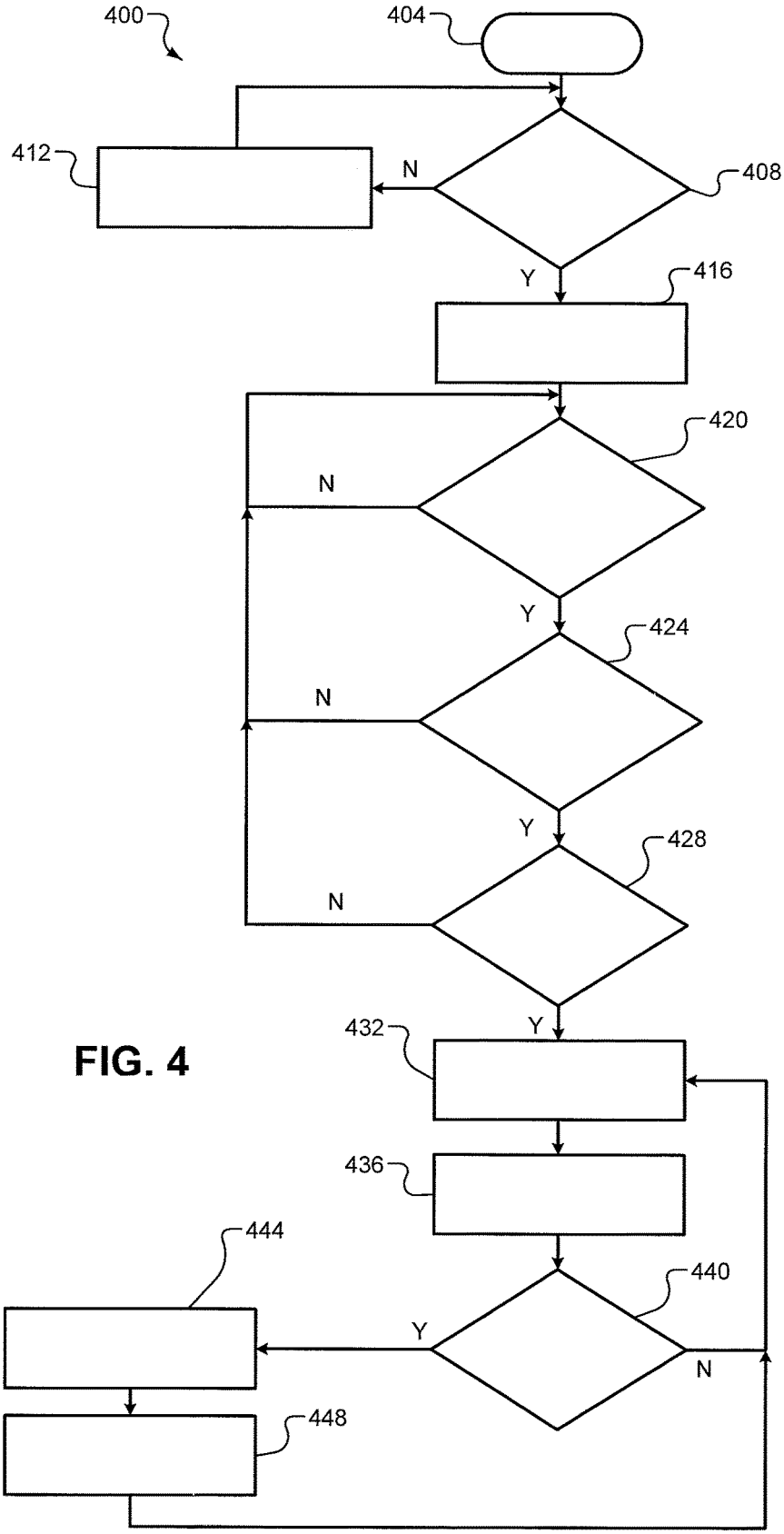
FIG. 4 is a flowchart depicting an example method of controlling a coolant pump using a correction factor according to the principles of present disclosure.

Referring now to FIG. 4, an example method 400 of controlling a coolant pump using a correction factor begins at 404. Various valves (e.g., the coolant valve 160, the thermostat valve 140, and the heater valve 144) may be closed and the coolant pump 132 may be off when control begins (e.g., control may begin, for example, at startup of the engine 104, when the engine oil and the transmission fluid may be cold). As described above, viscosity of the engine oil and the transmission fluid increases as temperature decreases, and vice versa.

At 408, the coolant valve control module 312 may determine whether the coolant trapped within the engine 104 is warming. If 408 is false, at 412, the pump control module 328 may maintain the coolant pump 132 off and the coolant valve control module 312 may maintain the coolant valve 160 closed. Retaining the coolant within the engine 104 allows the coolant within the engine 104 to warm and may warm the engine oil. If relatively cooler coolant was instead pumped into the engine 104, the relatively cooler coolant may cool the engine oil and the transmission fluid. The method 400 may return to 408 after 412. If 408 is true, the method 400 may continue with 416.

The coolant valve control module 312 may determine that the coolant trapped within the engine 104 is warming, for example, based on the coolant output temperature 320, engine oil temperature, and/or a transmission fluid temperature. At 416, the coolant valve control module 312 opens the coolant valve 160. Coolant can flow into the engine 104 when the coolant valve 160 is open.

From 420 to 428, the method 400 determines whether the coolant input temperature 324 and the coolant output temperature 320 are within a predetermined range for a predetermined period prior to updating a correction factor for a given position of the coolant valve 160. For example, the method 400 determines whether the coolant input temperature 324 is less than a first predetermined temperature and the coolant output temperature 320 is less than a second predetermined temperature for the predetermined period to ensure that the correction factor is not affected by hysteresis, system extremes and/or settling, etc. At 420, the method 400 determines whether the coolant input temperature 324 is less than the first predetermined temperature. If true, the method 400 continues to 424. If false, the method 400 returns to 420. At 424, the method 400 determines whether the coolant output temperature 320 is less than the second predetermined temperature. If true, the method 400 continues to 428. If false, the method 400 continues to 420. At 428, the method 400 determines whether the predetermined period has elapsed. If true, the method 400 continues to 432. If false, the method 400 continues to 420.

At 432, the method 400 determines a current position of the coolant valve 160. At 436, the method 400 controls the speed of the coolant pump 132 based on the position of the coolant valve 160 and a desired engine coolant output temperature. At 440, the method 400 determines whether the engine coolant output temperature 320 is different than the desired engine coolant output temperature for the position of the coolant valve 160. If true, the method 400 continues to 444. If false, the method 400 continues to 432. At 444, the method 400 generates and stores a correction factor for the current position of the coolant valve 160. For example, the method 400 generates the correction factor based on a function of a difference between the desired engine coolant output temperature and the engine coolant output temperature 320. The correction factor is stored in a map that correlates a plurality of the correction factors to respective positions of the coolant valve 160. At 448, the method 400 applies the correction factor to the speed of the coolant pump 132 and then continues to 432.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A OR B OR C), using a non-exclusive logical OR, and should not be construed to mean "at least one of A, at least one of B, and at least one of C." It should be understood that one or more steps within a method may be executed in different order (or concurrently) without altering the principles of the present disclosure.

In this application, including the definitions below, the term 'module' or the term 'controller' may be replaced with the term 'circuit.' The term 'module' may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. §112(f) unless an element is expressly recited using the phrase "means for," or in the case of a method claim using the phrases "operation for" or "step for."

What is claimed is:

1. A coolant control system of a vehicle, comprising:

a coolant valve control module that determines a position of a coolant valve; and a pump control module that receives the determined position of the coolant valve and a desired coolant output temperature and determines a speed of a coolant pump required to achieve the desired coolant output temperature when the coolant valve is in the determined position, measures a coolant output temperature with the coolant valve at the determined position and the coolant pump operating at the determined speed, determines a difference between the desired coolant output temperature and the measured coolant output temperature, generates a correction factor based on the difference between the desired coolant output temperature and the measured coolant output temperature, stores information correlating the correction factor to the determined position of the coolant valve, and applies the correction factor to the speed of the coolant pump in response to a determination that the coolant valve is in the determined position.

2. The coolant control system of claim 1, wherein:

the position of the coolant valve is one of a plurality of positions of the coolant valve; and the pump control module calculates a plurality of correction factors for respective ones of the plurality of positions of the coolant valve.

3. The coolant control system of claim 2, wherein:

the pump control module stores at least one of a map and a lookup table associating the plurality of correction factors to the respective ones of the plurality of positions of the coolant valve.

4. The coolant control system of claim 3, wherein:

the pump control module generates the correction factor by selecting the correction factor from the at least one of the map and the lookup table based on the determined position of the coolant valve.

5. The coolant control system of claim 2, wherein the plurality of correction factors for respective ones of the plurality of positions of the coolant valve are different.

6. The coolant control system of claim 1, wherein the correction factor is at least one of a multiplier and a coefficient to be applied to the speed of the coolant pump.

7. The coolant control system of claim 1, wherein the correction factor is indicative of a fault in the coolant control system associated with the determined position of the coolant valve.

8. A method for operating a coolant control system of a vehicle, the method comprising:

determining a position of a coolant valve;

receiving the determined position of the coolant valve and a desired coolant output temperature;

determining a speed of a coolant pump required to achieve the desired coolant output temperature when the coolant valve is in the determined position;

measuring a coolant output temperature with the coolant valve at the determined position and the coolant pump operating at the determined speed;

determining a difference between the desired coolant output temperature and the measured coolant output temperature;

generating a correction factor based on the difference between the desired coolant output temperature and the measured coolant output temperature;

storing information correlating the correction factor to the determined position of the coolant valve; and applying the correction factor to the speed of the coolant pump in response to a determination that the coolant valve is in the determined position.

9. The method of claim 8, wherein the position of the coolant valve is one of a plurality of positions of the coolant valve, the method further comprising:

calculating a plurality of correction factors for respective ones of the plurality of positions of the coolant valve.

10. The method of claim 9, further comprising:

storing at least one of a map and a lookup table associating the plurality of correction factors to the respective ones of the plurality of positions of the coolant valve.

11. The method of claim 10, further comprising:

generating the correction factor by selecting the correction factor from the at least one of the map and the lookup table based on the determined position of the coolant valve.

12. The method of claim 9, wherein the plurality of correction factors for respective ones of the plurality of positions of the coolant valve are different.

13. The method of claim 8, wherein the correction factor is at least one of a multiplier and a coefficient to be applied to the speed of the coolant pump.

14. The method of claim 8, wherein the correction factor is indicative of a fault in the coolant control system associated with the determined position of the coolant valve.

* * * * *